United States Patent [19]

Piragino

[11] Patent Number: 4,591,160

[45] Date of Patent: May 27, 1986

[54] GOLF CLUB HEAD

[75] Inventor: Alessandro Piragino, Turin, Italy

[73] Assignee: 'Pininfarina S.p.A., Turin, Italy

[21] Appl. No.: 590,397

[22] Filed: Mar. 16, 1984

[30] Foreign Application Priority Data

Mar. 17, 1983 [IT] Italy ..... 53069/83[U]

[51] Int. Cl.[4] ..... A63B 53/04

[52] U.S. Cl. ..... 273/167 R; 273/173; 273/DIG. 1; 273/DIG. 6; 273/DIG. 8

[58] Field of Search ..... 273/167 A, 167 R, 167 F, 273/167 H, 169, 170, 173, 231, 167 J, 167 K, 77 R, DIG. 1, DIG. 3, DIG. 4, DIG. 6, DIG. 8

[56] References Cited

U.S. PATENT DOCUMENTS

| | | | |
|---|---|---|---|
| 3,199,874 | 8/1965 | Blasing | 273/170 |
| 3,390,881 | 7/1968 | Senne | 273/173 |
| 3,507,495 | 4/1970 | Tucker et al. | 273/DIG. 8 |
| 3,616,101 | 10/1971 | Satchell et al. | 273/231 |
| 3,993,314 | 11/1976 | Harrington et al. | 273/170 |
| 4,244,855 | 1/1981 | Cox et al. | 273/231 |
| 4,438,931 | 3/1984 | Motomiya | 273/167 H |
| 4,451,041 | 5/1984 | Hayashi et al. | 273/DIG. 8 |

*Primary Examiner*—Richard C. Pinkham
*Assistant Examiner*—Vincent A. Mosconi
*Attorney, Agent, or Firm*—Sughrue, Mion, Zinn, Macpeak and Seas

[57] ABSTRACT

The golf club head comprises a shaped core body of material selected from synthetic and natural rubber and an outer shell closely surrounding substantially the entire surface of the core body of polymeric thermoplastic material selected from the group of polycarbonate, polyamide and polybutylene-terephthalate. According to a preferred embodiment, the golf club head further comprises a center core body embedded within the core body and consisting of closed envelope completely filled with liquid.

4 Claims, 3 Drawing Figures

GOLF CLUB HEAD

The present invention relates to golf club heads.

The object of the present invention is to provide a golf club head of simple construction and presenting improved properties particularly having regard to impact resistance, durability and propelling power.

To this end, the present invention provides a golf club head comprising:

a shaped core body of a material selected from synthetic and natural rubber and an outer shell closely surrounding substantially the entire surface of said core body, said shell being made of polymeric thermoplastic material selected from the group consisting of polycarbonate, polyamide and polybutylene-terephtalate and having a hardness of at least 70 Shore D.

According to a preferred embodiment, a center core body consisting of a closed envelope filled with liquid is embedded within said core body.

Figure 1:
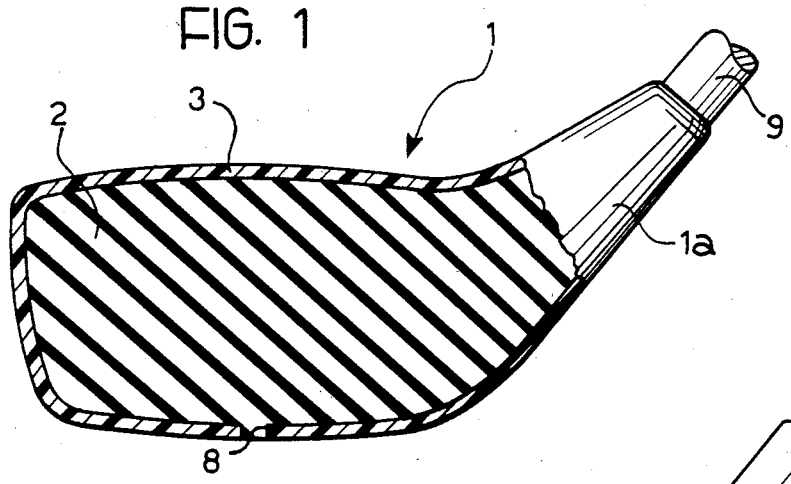
Figure 2:
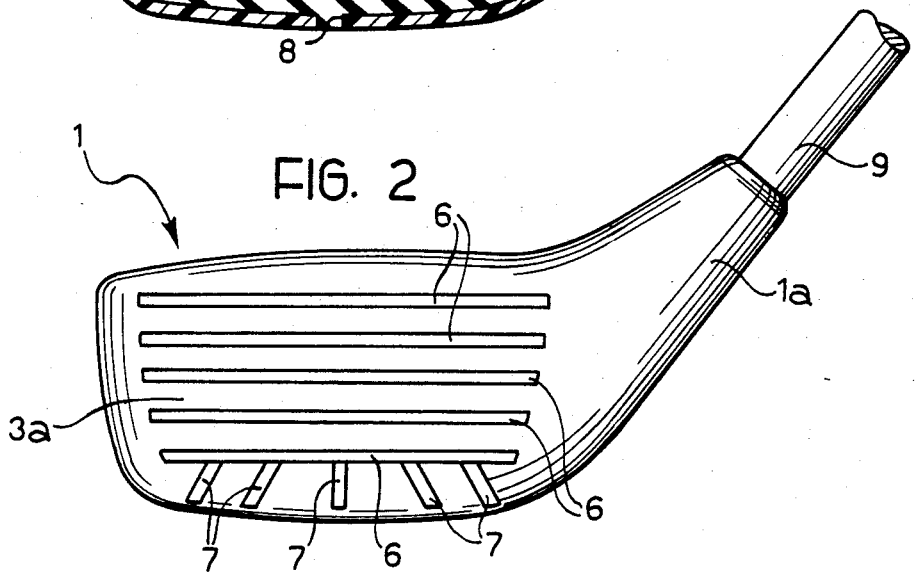
Figure 3:
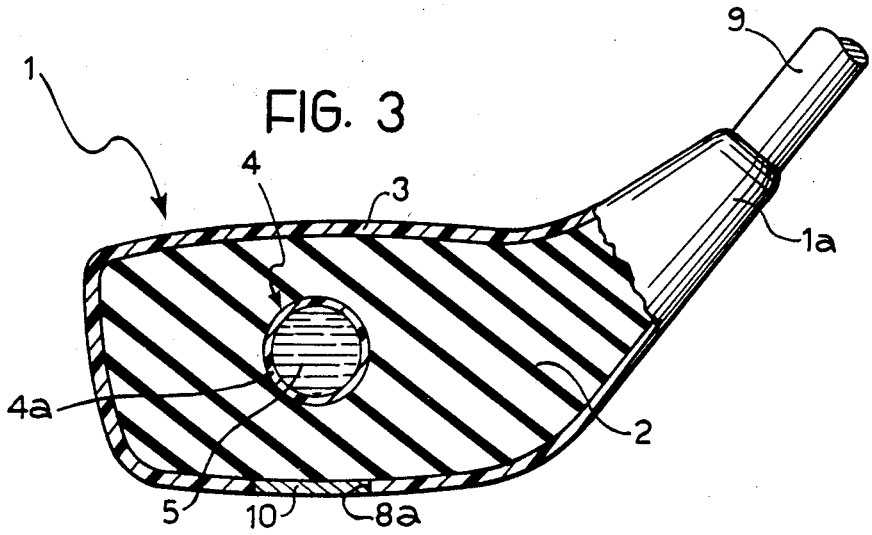

The present invention will now be described with reference to the enclosed drawing, wherein:

FIG. 1 is a partial cross-sectional view of a golf club head according to a first embodiment, FIG. 2 is a view in side elevation of the golf club head illustrated in FIG. 1, and FIG. 3 is a partial cross-sectional view of a golf club head according to a second embodiment.

Referring to FIGS. 1 and 2, a golf club head 1 is illustrated which comprises a core body 2 and an outer shell 3. The core body 2 is made of an elastomeric material such as natural and synthetic rubber, preferably of cast polyurethane. The shell 3 encasing the core body 2 is made of a polymeric thermoplastic material selected from the group consisting of polycarbonate, polyamide and polybutylene-terephtalate having a hardness of at least 70 shore D. Said shell has a thickness typically of from 3 to 6 mm and closely surrounds substantially the entire external surface of core body 2. The shell 3 includes a hitting surface 3*a*, which, as known in the art, is provided with horizontal grooves 6.

Preferably, the hitting surface 3*a* is also provided in the lower section thereof with sub-vertical or vertical grooves 7, merging into the lower horizontal groove 6. The grooves 7 have been found to be beneficial in that they act as guiding means helping the ball to raise toward the center of the hitting surface, whenever the ball is not properly hit.

According to a first method, the club head shown in FIGS. 1 and 2, is manufactured by initially moulding the shell 3 by any known process, such as injection-moulding, blow moulding, injection-blow moulding and rotational-moulding. After solidification of the shell, a hole 8 is bored through the surface of the shell which is then placed in a second mould. The core material is then cast into the shell at atmospheric pressure through hole 8 which is connected to a casting channel. Preferably, a slight superatmospheric pressure is applied to the casting material toward the end of the casting process to enhance the homogeneity of the casting and to provide for a complete filling of the shell. After a curing period to provide for vulcanization or cross-linking of the core material, a hole adapted for insertion of a club shaft 9 is bored into the frusto-conical section 1*a* of the club head 1.

According to a second method, the club head is manufactured by initially casting the core body 2 in a mould containing a metallic rod in order to provide for a cavity adapted for insertion of the club shaft 9. After a curing period, the shaped core body is then placed in a second mould to be coated by injection with the outer shell material.

According to the embodiment of FIG. 3 a center core body 4 is embedded within the core body 2. The center core body is of a substantially spherical shape and consists of a thin envelope 4*a* made of a film of plastic or elastomeric material with a thickness of about 0.1–0.5 mm which is completely filled with a liquid 5 such as water, vaseline or silicon oil.

Preferably, the center of gravity of the center core body 4 lays on the center of gravity of the club head.

Any of the manufacturing methods described hereinbefore may be applied to the manufacture of the golf club head according to the embodiment of FIG. 3.

Referring to the first method, a hole 8*a* is bored through the bottom surface of the outer shell 3, having a dimension such as to allow the introduction of the center core body 4. The shell is then reversed upside-down and the core material is poured into the shell through hole 8*a*. The center core body is then dropped into the shell through hole 8*a* when the casting material has filled about one half portion of the shell. The casting process is then continued up to complete filling of the shell, while the viscosity of the core material prevents the floating of the center core body. After solidification of the core body, the hole 8*a* is sealed by means of metallic sole plate 10.

Referring to the second manufacturing process described herinbefore, the center core body 4 is to be dropped into the mould through the casting channel.

I claim:

1. A golf club head comprising a shaped core body of materials selected from the group consisting of synthetic and natural rubber, a center core body having a substantially spherical shape embedded within said shaped core body and consisting of a closed envelope of plastic material completely filled with liquid, and an outer shell closely surrounding substantially the entire surface of said shaped core body, said shell being made of polymeric thermoplastic materials selected from the group consisting of polycarbonate, polyamide and polybutylene-terephthalate and having a hardness of at least 70 Shore D.

2. A golf club head according to claim 1 wherein the center of gravity of said center core body coincides with the center of gravity of said golf club head.

3. A golf club head according to claim 1 wherein said shaped core body material is cast polyurethane.

4. A golf club head according to claim 2 wherein the shaped core body material is cast of polyurethane.

* * * * *